United States Patent [19]

Coldewey et al.

[11] 3,971,427

[45] July 27, 1976

[54] VENETIAN BLIND PROFILED SLATS

[75] Inventors: Heiko Coldewey, Jeddeloh; Mario Ammazzalorso; Karl-Heinz Kaps, both of Oldenburg, all of Germany

[73] Assignee: Firma Justin Hüppe, Oldenburg, Germany

[22] Filed: Sept. 11, 1975

[21] Appl. No.: 612,552

Related U.S. Application Data

[63] Continuation of Ser. No. 465,430, April 29, 1974, abandoned.

[52] U.S. Cl. ..... 160/166 R; 160/236

[51] Int. Cl.[2] ..... E06B 9/26

[58] Field of Search ..... 160/178 R, 166 R, 236, 160/178 E, 178 F; 49/92

[56] References Cited

UNITED STATES PATENTS

| | | | |
|---|---|---|---|
| 2,292,001 | 8/1942 | Wright | 160/178 R |
| 3,254,451 | 6/1966 | Wills et al. | 49/92 X |
| 3,484,990 | 12/1969 | Kahn et al. | 160/236 X |

FOREIGN PATENTS OR APPLICATIONS

| | | | |
|---|---|---|---|
| 213,643 | 6/1967 | Sweden | 160/166 R |
| 467,416 | 2/1969 | Switzerland | 160/166 R |

*Primary Examiner*—Philip C. Kannan
*Attorney, Agent, or Firm*—Olson, Trexler, Wolters, Bushnell & Fosse Ltd.

[57] ABSTRACT

A venetian blind is provided having the usual plurality of slats. Each slat is profiled transversely of its length such that it has a central section and pair of edge sections. The control section is substantially flat and is inclined at an angle to a plane which passes through the outer edges of the edge sections whereby the blind can be completely closed without the necessity of tipping the central sections of the slats as far as in previous constructions.

6 Claims, 2 Drawing Figures

VENETIAN BLIND PROFILED SLATS

Figure 1:
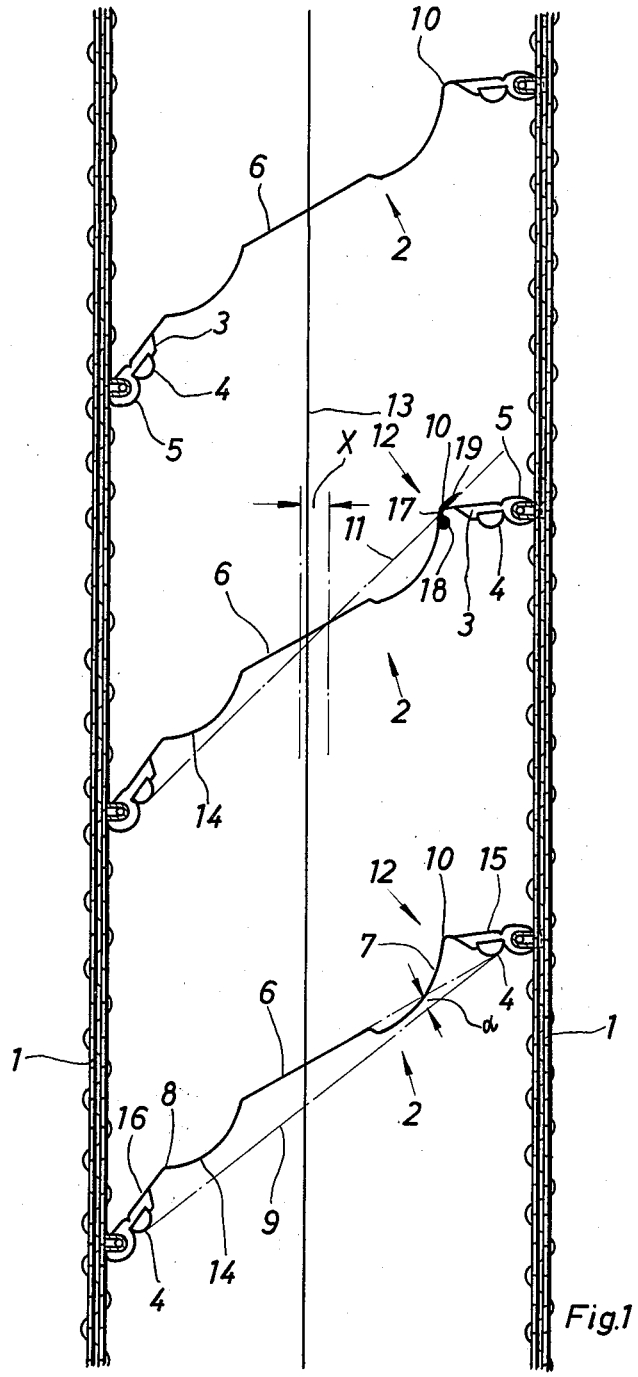

This is a continuing application of application Ser. No. 465,430, filed Apr. 29, 1974 now abandoned.

This invention relates to a venetian blind having slats profiled transversally to their length in such a way that each slat has edge sections connected to both sides of its central section.

From West German Registered Design No. 1,686,392, for example, a system is known in which slats are profiled in the aforementioned manner in place of the customary arcuate curve. In the said system, relatively narow edge sections are offset upwards, to a certain extent parallel, by being doubly bent at angles, so that they form, at a suitable distance from the outer edges, crosspieces parallel to the said edges and perpendicularly to the main plane of the slats and provided with perforations to accommodate catch plates to enable the slat to be affixed to supporting devices.

The present invention, on the other hand, is based on different considerations. The sealing effect obtained with a venetian blind very largely depends on the extent to which the adjacent slats overlap when the blind has been completely "turned". An obstacle to a largely vertical position for the slats in the "turned" position of the blind, however, is the necessity for ensuring that in this position the pulling devices, which act on the centre of the slats, pass through these latter perpendicularly. In the known constructions, therefore, venetian blinds could not be completely closed, or could only be closed by recourse to compromises inconvenient in other directions.

An object of the invention is to construct the slats of venetian blinds, particularly of those intended for exterior use, in such a way that when the blind is in the turned (closed) position the overlapping of the slats is practically complete, without detracting from the stability required from the slats which are made of thin material.

To achieve this object the invention provides a departure from the hitherto customary symmetrical construction of the slats in relation to their longitudinal central axis. This departure is adopted in view of the realisation of the fact that it is sufficient for the slats to overlap almost completely when turned through their maximum angle in one direction (starting from the horizontal position in which the slats are open) and that it is not necessary for the slats to occupy the same position in relation to one another in both extreme position.

On the basis of the construction described above, therefore, the present invention resides in the fact that the main plane of the central section is inclined at an angle with the connecting plane passing through the outer edges of the edge sections.

The connecting plane plays an essential part in determining the degree of darkening obtainable with a venetian blind; if the connecting plane of a slat in the fully turned position contacts the adjacent slat, this in tantamount to complete overlapping. The oblique position which the central section of the slat assumes, according to the invention, in relation to the said connecting plane enables the slats to be tilted at a considerable angle, after being turned in one direction without causing the central section to assume too small an angle in relation to the vertical pulling device of the blind.

The sealing effect obtained with the blind when it has been turned in the preferred direction can be intensified if, in a preferred manner, the edge section adjacent to that side of the central section which is nearer to the connecting plane comprises a protuberance of which the height is such that a straight connecting line between its tip and the outer edge of the other edge section will pass through the central section. The imaginary straight connecting line is in practice occupied by the pulling device, such as a pulling tape, which thus on the one hand passes through the passage in the central section of the slat and on the other hand can take its course between the tip of the protuberance of a slat and the closely adjacent outer edge of the adjacent slat, contacting the said parts. An elastic coating on the protuberance of the profiled slat can be provided as a means of excluding the light still more complete and serving as a buffer between the slats.

The other edge section preferably includes a depression so that in the "turned" position the surface of the slat will not touch the adjacent supporting device.

In the case of venetian blinds having slats of which the outer edges are flanged inwards and into which securing devices are clamped, to enable the slats to be connection to the supporting devices, it is of advantage for largely flat parts of the edge sections to be provided between on the one hand between the tip of the protuberance of the profiled slat and the commencement of the edge flanging and on the other hand between the depression in the profiled slat and the commencement of the edge flanging, against the internal surfaces of which the securing clips can come to rest. This system is arranged, in particular, in such a manner that the flat part of the edge section having the protuberance encloses a greater angle than the central section with the connecting plane, while the flat part of the other edge section encloses with the said plane an angle opposite to that enclosed by the central section.

Figure 2:
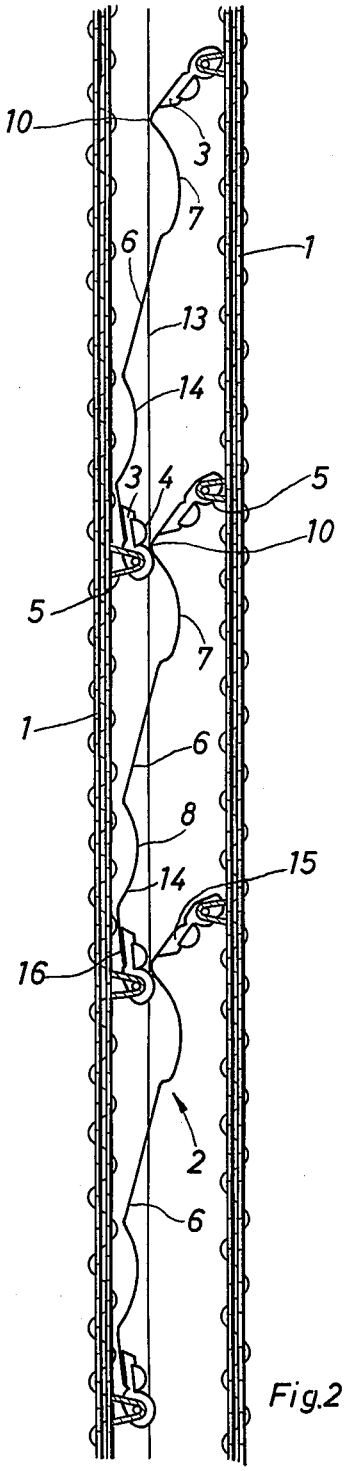

In order that the invention may be more readily understood it will now be described, by way of example only with reference to the accompanying drawings in which:

FIG. 1 shows, in cross-section, a portion of the slat system (with three slats) of a venetian blind according to the invention, in a mainly open position, FIG. 2 shows a corresponding portion in the form which it takes when the blind has been turned completely towards the closed position.

Between parallel supporting cords 1 of the same kind, of which a number of pairs are distributed over the width of the blind, slats 2 are pivotably held by the aid of securing clips 3 which on the one hand are inserted from the side into the edge flanges 4 of the slats 2 and on the other hand suspended in loops 5 on the supporting cords 1. This method of securing them is known from German Provisional Disclosure No. 2,212,894 and need not be described here in detail.

Each slat 2 has a central section 6 and edge sections 7 and 8 immediately adjacent this central section in its respective longitudinal sides. FIG. 1 shows, by means of a dot-and-dash line 9, for the lowest slat 2, the connecting plane which was mentioned above and which makes contact with the flanges 4 of the outer edges. This clearly shows that the flat central section 6 and the connecting plane (dot-and-dash line 9) enclose an acute angle $\alpha$.

The edge section 7 which is located on the right of the central section as shown in FIG. 1 comprises a protuberance 10, and the dot-and-dash line 11 shown on the central slat in FIG. 1, as the straight connecting line between the tip 12 of the protuberance 10 and the flange 4 of the outer edge, on the other edge section 8, passes through the central section 6 of the slat 2. The intersection point of the line 11 and the central section 6, for all practical purposes, determine the width required in this direction for the passage (not shown in the drawing) provided in the slat 2 for the pull tape 13; the dimension X between the two edges of the passage, transversally to the slat, as shown in FIG. 1 for the central slat, indicates how small the aperture can be owing to the oblique position of the central section 6.

The profile of the other edge section 8 of the slat 2 includes a depression 14; it is relatively shallow and serves on the one hand to prevent contact between the slat and the adjacent pull cord 1 (FIG. 2), when the slat has been turned, and on the other hand to impart additional stability to the slat.

Those parts of both edge sections 7 and 8 are immediate outwardly of the protuberance 10 and the depression 14 respectively are largely of flat form. In the zone in which the flat portions are secured, the securing clips 3 rest against their underside. FIG. 1 shows that the part 15 of the edge section 7 encloses a larger angle with the connecting plane between the outer edges (dot-and-dash line 9) than the angle $\alpha$ between the said plane and the central section 6; the angle between the part 16 of the other edge section 8 is opposite to the angle $\alpha$.

FIG. 2 shows how, when the slats 2 have been turned into the position corresponding to the closing of the blind, the protuberance 10 of each slat 2 comes to rest almost against the flange 4 on the other hand edge section 8 of the next slat above that in question, so that the slats completely overlap and exclude all light. The pull tape nevertheless takes a straight course between the slats and, as described above, passes through passages in the central section 6.

The central slat 2 shown in FIG. 1 represents a further embodiment of the invention. In this case the protuberance 10 is provided with an elastic coating consisting of a plastic pad 17 which, by a suitable attachment, engages a profiled beading 18. This latter is inwardly of the protuberance 10 and shaped into the slat 2 a slight distance below the tip 12 of the said protuberance. A section 19 of the pad 17 extends outward to the side, beyond the tip 12 of the protuberance 10, in such a way that it is inclined upwardly from the flat part 15 of the edge section 7. This ensures that adjacent slats 2 will overlap sufficiently to exclude the light, even if, owing to the unavoidable manufacturing tolerances, the tip 12 of the protuberance 10, when the blind is closed, does not accurately rest against the flanged edge of the adjacent slat.

Although in the version described in the foregoing, pull cords arranged in pairs are attached to the slats by means of clips, it is naturally also possible to use conventional supporting bars in conjunction with the new slats, the latter then being inserted between their cross-pieces.

As usual, the slats 2 are formed from a light metal, alternate ends of successive slats being guided by end lugs in lateral guide bars.

What we claim is:

1. A venetian blind having a plurality of slats carried by supporting devices each of which is profiled transversely to its length, each slat having a substantially planar central section and first and second edge sections respectively connected to and integral with opposite sides of said central section and respectively having free outer edges, the main plane of the central section being inclined at an acute angle with the connecting plane which passes through the outer edges of the edge sections, said central section having openings therein, raising devices extending through said openings, each slat having an asymmetrical cross-sectional profile such that said first edge section adjacent the central section includes a protuberance, a straight line between the top of said protuberance and the outer edge of said second edge section passing through said main plane, and pivot link means at said outer margins of said slats for connection with said supporting devices, said supporting devices being formed by a pair of vertical strips on either side of said slats.

2. A venetian blind as claimed in claim 1 wherein the profile of the second edge section of each slat includes a depression.

3. A venetian blind as claimed in claim 1 wherein the profile protuberance on each slat is provided with a coating of an elastic material.

4. A venetian blind as claimed in claim 3 wherein the coating consists of a plastic pad engaging a profiled beading provided in the edge section and positioned in the longitudinal direction of the slat.

5. A venetian blind as claimed in claim 1, wherein the edge sections of each slat respectively have substantially flat portions which include the edge sections, said flat portions of each slat respectively forming with said connecting plane a larger angle than does the central section.

6. A venetian blind as claimed in claim 5 wherein the flat part of the second edge section encloses an angle with skid connecting plane which is opposite to that enclosed by the central section of the slat and the connecting plane.

* * * * *

UNITED STATES PATENT AND TRADEMARK OFFICE

CERTIFICATE OF CORRECTION

PATENT NO. : 3,971,427

DATED : August 27, 1976

INVENTOR(S) : Heiko Coldewey, Mario Ammazzalorso, Karl-Heinz Kap

It is certified that error appears in the above-identified patent and that said Letters Patent are hereby corrected as shown below:

Col. 1, line 13, "narow" should be --narrow--

Col. 1, line 17, "perpendicularly" should be --perpendicular-

Col. 2, line 57, "in" should be --on--

Col. 3, line 32, after "other" delete --hand--

Col. 4, line 50, "skid" should be --said--

Signed and Sealed this

Second Day of November 1976

[SEAL]

*Attest:*

RUTH C. MASON
*Attesting Officer*

C. MARSHALL DANN
*Commissioner of Patents and Trademarks*